United States Patent [19]

Luthi

[11] Patent Number: 5,046,338

[45] Date of Patent: Sep. 10, 1991

[54] MULTIPHASE PULP WASHER

[75] Inventor: Oscar Luthi, Nashua, N.H.

[73] Assignee: Ingersoll-Rand Company, Woodcliff Lake, N.J.

[21] Appl. No.: 537,249

[22] Filed: Jun. 13, 1990

[51] Int. Cl.[5] ..... D21C 1/02

[52] U.S. Cl. ..... 68/43; 68/158; 68/181 R

[58] Field of Search ..... 68/158, 181.2, 43; 162/380; 210/392, 402, 407

[56] References Cited

U.S. PATENT DOCUMENTS

| | | | |
|---|---|---|---|
| 4,213,822 | 7/1980 | Eriksson | 68/181 R |
| 4,266,413 | 5/1981 | Yli-Vakkuri | 68/181 R X |
| 4,292,123 | 9/1981 | Lintunen et al. | 68/181 R |
| 4,769,986 | 9/1988 | Kokkonen et al. | 162/380 |
| 4,827,741 | 5/1989 | Luthi | 68/158 |
| 4,894,121 | 1/1990 | Lutni et al. | 68/181 R |
| 4,952,314 | 8/1990 | Henricson et al. | 68/181 R |

*Primary Examiner*—Frankie L. Stinson

*Attorney, Agent, or Firm*—Robert F. Palermo

[57] ABSTRACT

Multiphase washing of pulp is accomplished on a fully pressurized drum filter by employing compaction baffles to increase the consistency of the pulp mat and by providing a separate pump for each wash zone so that there is no pressure difference between the wash zones and, thus, no need for any mat contacting mechanical seal. This avoids mat disruptions and machine clogging often caused by pulp pile-up at such seals. Feed pulp of relatively high consistency is made possible by incorporation of a deflocculator and distributor in the pulp feed nozzle.

9 Claims, 3 Drawing Sheets

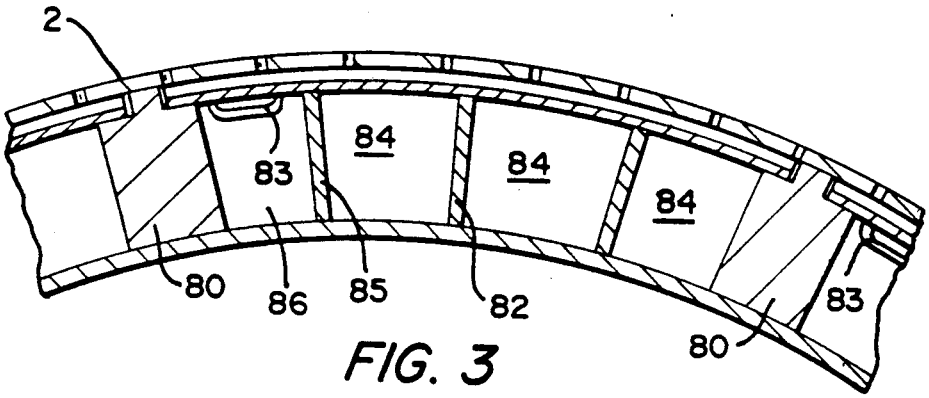
FIG. 3
FIG. 4
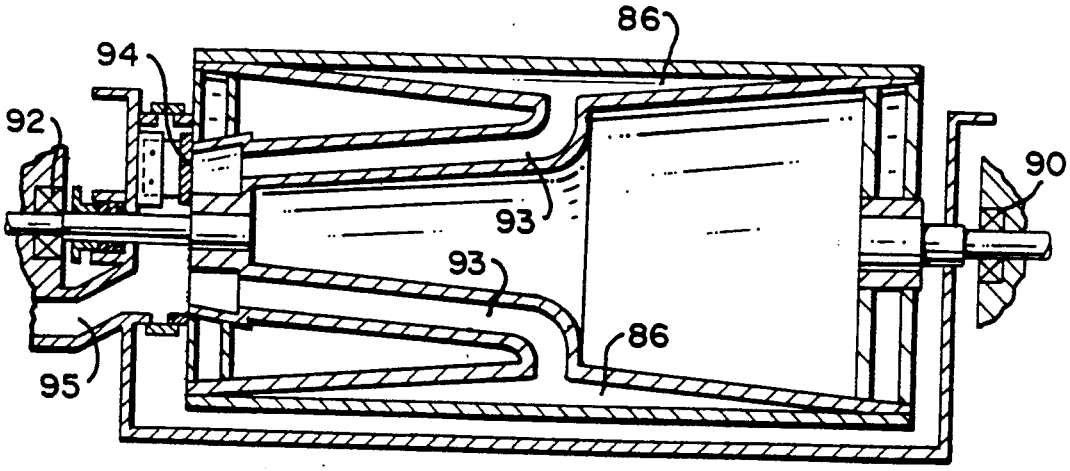

MULTIPHASE PULP WASHER

BACKGROUND OF THE INVENTION

This invention relates generally to processing of pulp for papermaking and more particularly to washing of the pulp on a drum filter.

Processing of papermaking pulp requires washing to remove the digesting liquor. This has been performed in a series of pulp washers or in a single multiphase washer. After each washing cycle, i.e., after removal from each washer, the pulp mat is commonly diluted, formed into a new pulp mat, and washed again until the desired degree of washing is accomplished. If washing is prolonged, channels form in the mat and the wash liquor flows through those channels instead of displacing the pulping liquor. For effective washing, the pulp mat must be as uniform as possible, and washing must only continue so long as the degree of channeling is not excessive. This allows maximum displacement of pulping liquor by a minimal amount of wash liquor.

In multiphase washing, the mat is washed several times without reforming. After the first wash phase, washing becomes less effective due to channeling. Thus, the number of wash phases which can be effective in a single pulp mat washing cycle is limited.

Various types of multiphase pulp washers are used. One of these is a belt washer wherein the pulp is washed by a series of showers as it travels horizontally on a flexible belt over a number of vacuum boxes. The wash liquor flow is countercurrent, meaning that the wash liquor for the first shower is fed from the effluent of the second shower. The last shower is fed by the cleanest water.

Operation of belt washers is costly due to belt wear caused by dragging the belt across the vacuum boxes, the belt tension needed to drag it across those boxes, the operating temperature, and the corrosive action of the pulp liquor. In addition, distribution of the shower liquor is not uniform, and tends to disrupt the mat aggravating the channeling condition.

One known drum type washer features two phase washing with countercurrent flow. The wash liquor is applied under pressure so that it flows through the pulp mat to the inside of the filter drum.

In this design, the wash zones are quite short which limits the drum speed and, hence, the capacity. Since there is one pump for the wash liquor, seals are required between the zones, to prevent crossflow between the zones. Seal contact against the pulp mat can cause disruption of the mat, pulp pile-up at the seals, and clogging of the machine.

Another problem associated with this design is excessive bearing wear and cylinder ring deflection, due to unbalanced radial side loads caused by the unbalanced pressure. Exposure of the inside of the cylinder and its reinforcing rings to the corrosive liquor also contributes to deterioration of the cylinder structure.

In vacuum washers, the wash liquor is collected in the deck channels and piped to a valve at one or both ends of the cylinder. Thus, the interior drum structure is protected from the corrosive effects of the wash liquor.

To obtain effective displacement washing, the pulp mat must be well formed and free of channels and lumps. Avoiding formation of flocs and a non-uniform pulp mat on a vacuum filter, requires that the pulp be fed at a consistency below about 1½%. It is, therefore, necessary to heavily dilute the feed pulp. This requires a large quantity of forming liquor and, consequently, large deck drainage channels which permit excessive intermixing between filtrates collected at the forming zone and the washing zone. This makes multiphase washing on vacuum filters impractical.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the invention, this is accomplished by providing a multiphase pulp washer comprising a generally drum shaped rotatable filter having segregated low-volume interior filtrate drainage channels. The filter is rotated about its axis while pulp, at 4% to 6% consistency is fed to form a pulp mat on a surface of the filter. After forming, the pulp mat is pressed on the filter surface to increase its consistency by more than 150% and to thereby decrease the required volume of wash liquor and passes through at least two wash phases in each of which it is washed with wash liquor fed by a separate pump for that wash phase. This makes it possible to maintain uniform constant fluid pressure about the entire circumference of said drum shaped filter.

The foregoing and other aspects will become apparent from the following detailed description of the invention when considered in conjunction with the accompanying drawing figures.

BRIEF DESCRIPTION OF THE DRAWINGS

FIG. 3 is a fragmentary schematic sectional transverse view of one port of the filter drum deck; and FIG. 4 is a longitudinal schematic cross section of the filter drum showing one possible drainage scheme.

DETAILED DESCRIPTION

Figure 1A:
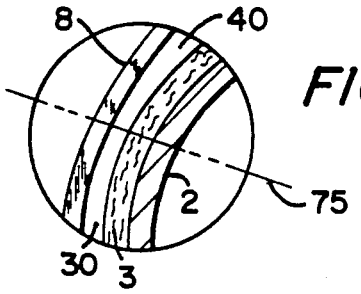
FIG. 1A is an enlarged view of the circled portion labeled "A" in FIG. 1.
Figure 1:
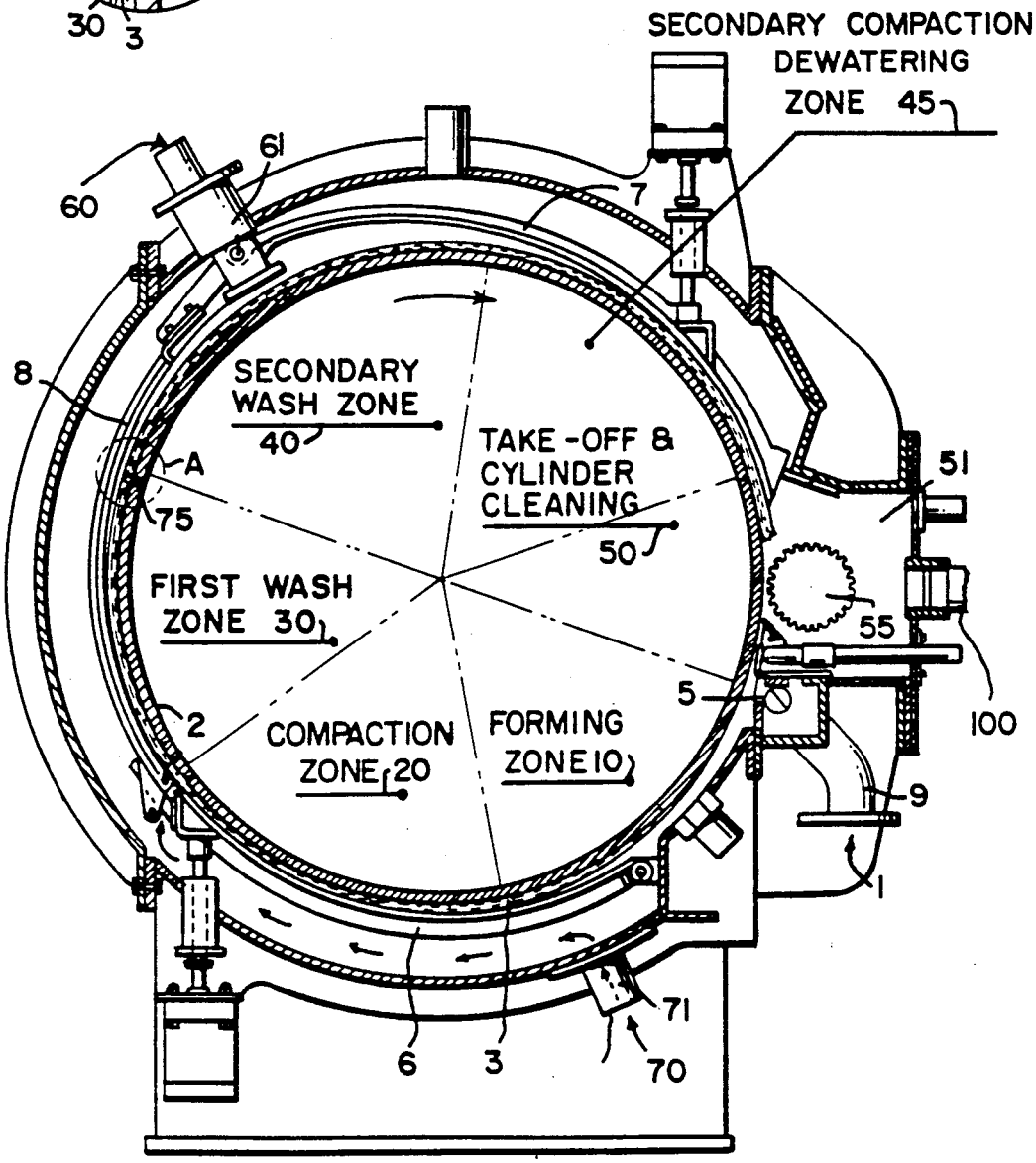
FIG. 1 is a schematic cross sectional transverse view of a multiphase washing filter.

Referring to FIG. 1, the feed pulp 1 is fed to the filter surface 2 through pulp feed nozzle 9. Near the discharge end of pulp feed nozzle 9 is a pulp distributor and deflocculator 5 which prevents pulp floc formation to avoid a lumpy mat. The pulp mat 3 is formed in forming zone 10 by the filtering action of the filter surface 2 upon the feed pulp 1.

To optimize the washing process, a deflocculator and pulp distributor 5 is provided in the pulp feeder 9. The pulp distributor provides uniform spreading of the pulp along the full length of the filter. The deflocculator 5 prevents formation of flocs or lumps. Without the deflocculator, the consistency of feed pulp 1 would have to be maintained at less than approximately 1½%. Provision of the deflocculator 5 permits feeding of the pulp at a consistency of approximately 4 to 6%. This means that the liquor volume in the forming zone 10 is approximately one-fourth what it would be, were it not for the deflocculator. Thus, smaller flow channels may be used within the deck and filtrate mixing is reduced accordingly.

After the pulp mat 3 is formed, it travels through the compaction zone 20 on the filter surface 2 where it is pressed by a first compaction baffle 6 having very gradual convergence to increase the consistency and the uniformity of the pulp mat 3. In first wash zone 30, it is washed by the first wash liquor 70 which is fed to the pulp mat 3 through first wash liquor nozzle 71. This wash liquor 70 fills the space outside the first compaction baffle 6 and the excluder baffle 8. It passes through the slot between the compaction baffle 6 and the excluder baffle 8 to wash the pulp mat 3 on the deck 2 in the first wash zone.

Following the first wash zone 30 is the second wash zone 40. In this zone, the second wash liquor 60 is fed through the second wash liquor nozzle 61 from which it flows beneath the excluder baffle 8 and second compaction baffle 7. In the circled region labeled A, an interface 75, as shown enlarged in FIG. 1A, exists between the two wash liquors at the boundary of the wash zones 30 and 40. This is merely a liquid interface and does not include any mechanical separation features. This interface is possible because both the first wash liquor 70 and the second wash liquor 60 are fed by separate pumps which maintain a pressure equality between the two wash zones. There is, therefore, no tendency for either wash liquor to flow into the neighboring wash zone.

Provision of a separate wash liquor supply pump for each wash zone permits operation of the multiphase washer without seals between the wash zones. Because both zones are maintained at equal pressure, there is no driving force for inter-zone flow. The only mechanical separation required is provided by an excluder baffle which does not touch the pulp mat and which separates the wash liquors of the two wash zones prior to their contact with the pulp mat.

During travel of the pulp mat 3 beneath the second compaction baffle 7 it is further dewatered to a consistency of about 15–24% in the second compaction and dewatering zone 45 before it reaches the take-off zone 50 where it is diluted to approximately 12% and removed from the deck by take-off roll 55 or other take-off means. It then passes from the discharge box 51 through the pulp outlet 100.

Figure 2:
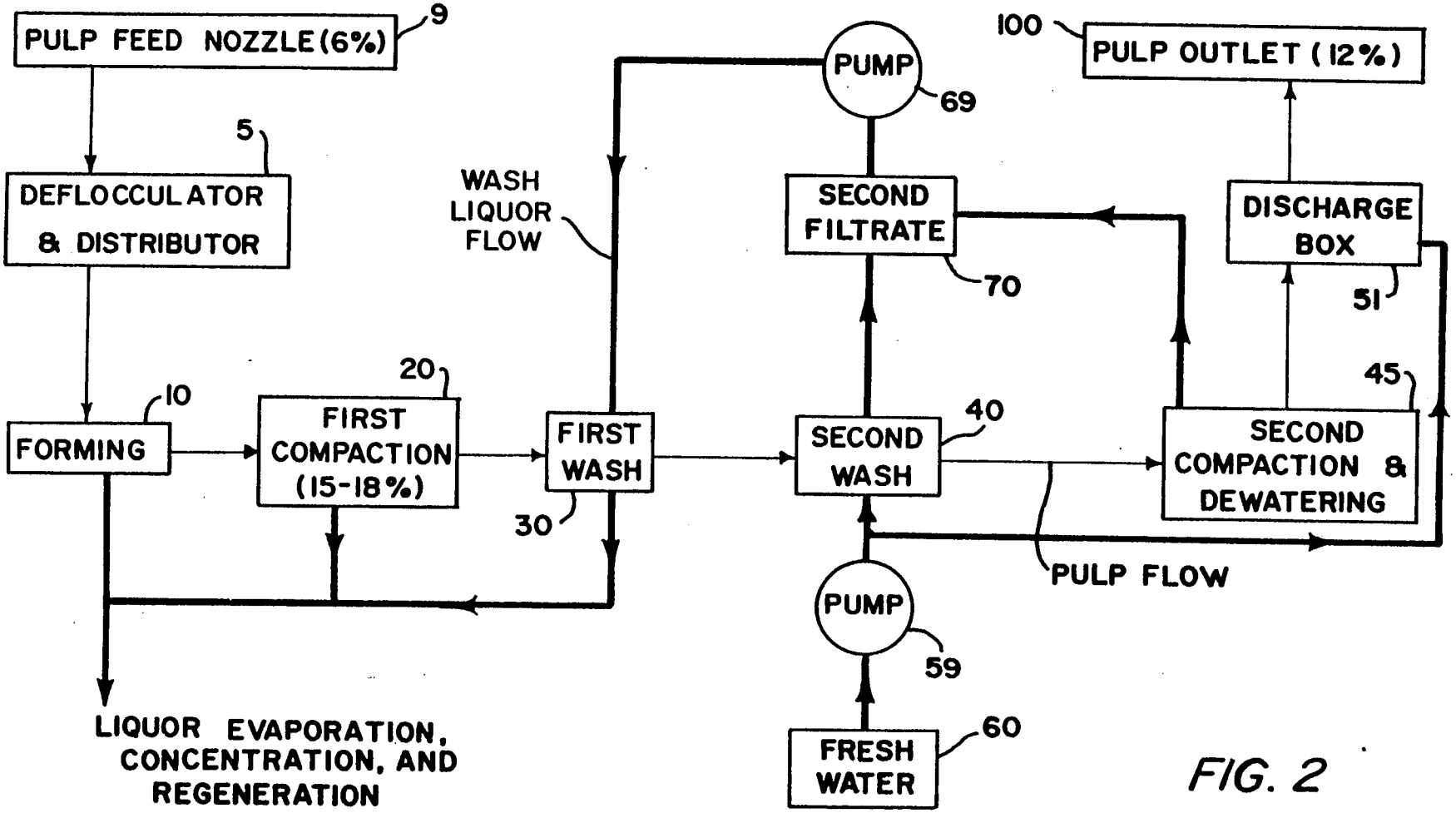
FIG. 2 is a flow chart showing the countercurrent paths of the pulp mat and wash liquor.

FIG. 2 presents a schematic flow chart which illustrates the countercurrent paths of the pulp mat and the wash liquor. In this figure, the pulp travels in a rightward direction, the wash liquor travels in a generally leftward direction.

It should be noted that the feed pulp is supplied at a consistency of approximately 12% and is diluted to 4 to 6% before passing through pulp feed nozzle 9. From there, after passing through the deflocculator and distributor 5, the pulp enters forming zone 10 where the pulp mat 3 is formed by extraction of a portion of the pulp liquor. Immediately after forming, the mat passes through the first compaction zone 20 in which its consistency is raised to approximately 15 to 24%.

Achievement of this relatively high consistency prior to washing makes it possible to reduce the amount of wash liquor necessary to achieve thorough displacement of the pulp liquor in the mat. Because of the low degree of dilution; the pulp liquor effluent requires a significantly lessor amount of evaporation and concentration for regeneration. Once it is compacted, the pulp mat 3 passes through the first wash zone 30 where the first displacement washing is performed.

The second wash zone 40 immediately follows first wash zone 30. After the second wash, the pulp mat enters the second compaction zone 45 where it is again compacted to approximately 15–24%. At this higher consistency, the pulp is more readily removed from the filter drum as it enters the discharge box 51. From there it is discharged at the higher consistency or at a desired diluted consistency through the pulp outlet 100.

The flow of wash liquor through the system is countercurrent to that of the pulp. Starting with a fresh water supply 60, pump 59 forces the water through the pulp mat in second wash zone 40. In second wash zone 40, the wash water displaces the wash liquor of first wash zone 30. During this displacement the consistency of the pulp mat is maintained at approximately 12%—the same consistency at which it left first wash zone 30. During its travel through the second compaction and dewatering zone 45, the consistency of the mat is increased to approximately 15–24% prior to entering the discharge box 51. Filtrate from the second compaction and dewatering zone 45, and filtrate from the second wash zone 40, is collected in a reservoir for first wash liquor 70. From there, first wash liquor pump 69 forces the first wash liquor 70 through the pulp mat in first wash zone 30. The filtrate from first wash zone 30, together with the filtrate from first compaction zone 20 and forming zone 10, are collected and part of this liquor is used to dilute the feed consistency to 4–6%. The balance is returned to the liquor treatment operation for evaporation, concentration, and regeneration. Thus, the first displacement wash is performed with the filtrate from the second wash. After first wash zone 30, and aggregation with the filtrate from the first compaction zone 20 and the forming zone 10, the liquor is slightly more concentrated than it was after the first wash only. A degree of dilution is unavoidable in the washing process; however, this dilution is minimized in the present invention for the reasons already described.

FIG. 3 shows a schematic transverse cross section of one port of the drum deck. In this view, are shown filter surface 2, division grids 80, support grids 82, sealed channels 84, drain divider grid 85, deck drainage flow channel 86, and corrugated deck drain 88. It should be noted that support grids 82, unlike those of many standard filter drum decks are preferably solid and result in sealed channels 84 which do not communicate with deck drainage flow channel 86. All support grids 82 except the drain divider grid 85, separating deck drainage flow channel 86 from sealed channels 84, may be optionally perforated. Thus, the only drainage path from filter surface 2 is along the circumferential corrugations of the deck below filter surface 2, through corrugated deck drain 88, and then into deck drainage flow channel 86. This relatively small drainage channel volume limits the mixing of filtrates, because it provides for incremental separation. This is separation of the first filtrate in a wash zone, and the middle filtrate in that zone from each other and from the last filtrate as chronologically generated.

FIG. 4 shows a schematic longitudinal cross section of a filter drum and indicates one possible drum drainage scheme. Bearings 90 and 92 support the drum for rotation.

Next to bearing 92 is drain control valve 94 and drum drain 95. Drain control valve 94 is designed to incrementally segregate the filtrate from the first and second pulp wash zones 30 and 40, respectively. Drainage flow channel 86 is shown tapering toward the drum center from where it connects to the drain control valve 94 by means of drainage tube 93. Note that, because of the small drainage flow channels 86, it is preferred that they be as short as possible in order to drain completely in the minimum time. Thus, a filter drum of great length may require quarter point drainage in order to maintain the preferred short and fast draining deck drainage flow channels 86 and may even require valves and drains at both ends of the drum. In this way the incremental filtrate separation is made possible and filtrate can be segregated in each work zone according to when it was generated within that zone.

Under the conditions described, the flow volume within the deck drainage flow channels 86 will equal approximately one-third to one-fourth of the wash liquor flow per cylinder revolution per phase under commonly used supply conditions for the wash liquor.

The foregoing has described a multiphase washing system which employs two wash zones. The use of two washing zones is preferred, because it permits longer wash zones, higher rotation speed, and thus higher washing capacity. It would be possible, however, to design this system using three or more wash zones.

Having described the invention, what is claimed is:

1. A multiphase pulp washer comprising:

a generally drum shaped rotatable filter having segregated low-volume interior deck filtrate drainage channels;

means for rotating said drum shaped filter about its axis;

means for feeding pulp, at 4% to 6% consistency, to the filter surface to form a pulp mat;

means for pressing the pulp mat on the filter surface to increase the consistency thereof by more than 150% and to thereby decrease the required volume of wash liquor;

at least two wash phases; and one wash liquor supply pump means for each wash phase for maintaining uniform constant fluid pressure about the entire circumference of said drum shaped filter.

2. The multiphase pulp washer of claim 1 wherein said segregated low-volume interior deck filtrate drainage channels reduce filtrate mixing by rapidly draining filtrate according to its time of displacement from said pulp mat.

3. The multiphase pulp washer of claim 2 wherein each deck filtrate draining channel has a drainage capacity in the range of 20% to 40% of the wash liquor supplied per wash phase for each drum revolution

4. The multiphase pulp washer of claim 1 wherein the means for feeding pulp at 4% to 6% consistency to the filter surface comprises a pulp feed nozzle, a deflocculator means for limiting floc formation, and a pulp distributor for providing uniform smooth distribution of pulp along the filter surface.

5. The multiphase pulp washer of claim 1 wherein the means for pressing the pulp mat to increase consistent by more than 150% and to thereby decrease the required volume of wash liquor comprises at least one compaction baffle having very slow convergence toward the filter surface.

6. The multiphase pulp washer of claim 1 further comprising:

means for removing the washed pulp from the filter drum.

7. The multiphase pulp washer of claim 6 wherein the means for removing the washed pulp from the filter drum comprises a pulp take-off roll in a discharge box.

8. The multiphase pulp washer of claim 1 wherein the wash liquor for each wash phase is separately pumped, comprises the filtrate from the succeeding wash zone, and requires no pulp-contacting mechanical seal to prevent cross flow between wash phases because separate pumping permits maintenance of uniform pressure around the filter surface.

9. In a pulp washer of the type having a perforated rotatable drum filter made up of a plurality of ports with segregated interior filtrate drainage channels, a device for feeding pulp to the filter surface to form a pulp mat, one or more compaction baffles to compact the pulp mat to a medium high consistency of about 15% to 24%, and at least two countercurrent wash phases, the improvement comprising:

one wash liquor supply pump means for each wash phase for maintaining uniform constant pressure at all locations about the filter drum surface; and low volume rapidly drainable filtrate drainage channel means for restricting filtrate dilution and intermixing by providing sequential incremental drainage of each port of the filter deck.

* * * * *